US006884336B2

(12) United States Patent
Kia et al.

(10) Patent No.: US 6,884,336 B2
(45) Date of Patent: Apr. 26, 2005

(54) COLOR FINISHING METHOD

(75) Inventors: Sheila Farrokhalaee Kia, Bloomfield Hills, MI (US); Hong-Hsiang Kuo, Troy, MI (US); Yar-Ming Wang, Troy, MI (US)

(73) Assignee: General Motors Corporation, Detroit, MI (US)

( * ) Notice: Subject to any disclaimer, the term of this patent is extended or adjusted under 35 U.S.C. 154(b) by 34 days.

(21) Appl. No.: 10/337,257

(22) Filed: Jan. 6, 2003

(65) Prior Publication Data

US 2004/0129574 A1 Jul. 8, 2004

(51) Int. Cl.[7] ..... C25D 11/14; C25D 11/16; C25D 11/04

(52) U.S. Cl. ..... 205/324

(58) Field of Search ..... 205/324, 325, 205/328, 329, 330, 331, 332, 333

(56) References Cited

U.S. PATENT DOCUMENTS 4,116,699 A * 9/1978 Rooney ..... 252/79.4
4,414,077 A * 11/1983 Yoshida et al. ..... 205/105
4,624,752 A 11/1986 Arrowsmith et al. ..... 204/37.6
5,132,003 A 7/1992 Mitani ..... 205/173
5,820,740 A * 10/1998 Le et al. ..... 205/171
5,904,989 A 5/1999 Hanggi et al. ..... 428/457
6,045,677 A * 4/2000 Beetz et al. ..... 205/50
6,455,110 B1 9/2002 Fortuyn et al. ..... 427/475
2003/0075452 A1 * 4/2003 Hsu et al. ..... 205/203
2003/0127338 A1 * 7/2003 Beier-Korbmacher et al. ... 205/229

FOREIGN PATENT DOCUMENTS

EP 0429656 B1 9/1995

* cited by examiner

*Primary Examiner*—Roy King
*Assistant Examiner*—Harry D. Wilkins, III
(74) *Attorney, Agent, or Firm*—Kathryn A. Marra

(57) ABSTRACT

A method for the color finishing of aluminum frames and other components for motor vehicles comprises anodizing an aluminum surface and coloring the aluminum surface. The coloring of the aluminum surface may be effected by an adsorptive coloring process, an electrolytic coloring process, an interference coloring process, or any combination of the foregoing processes.

12 Claims, 1 Drawing Sheet

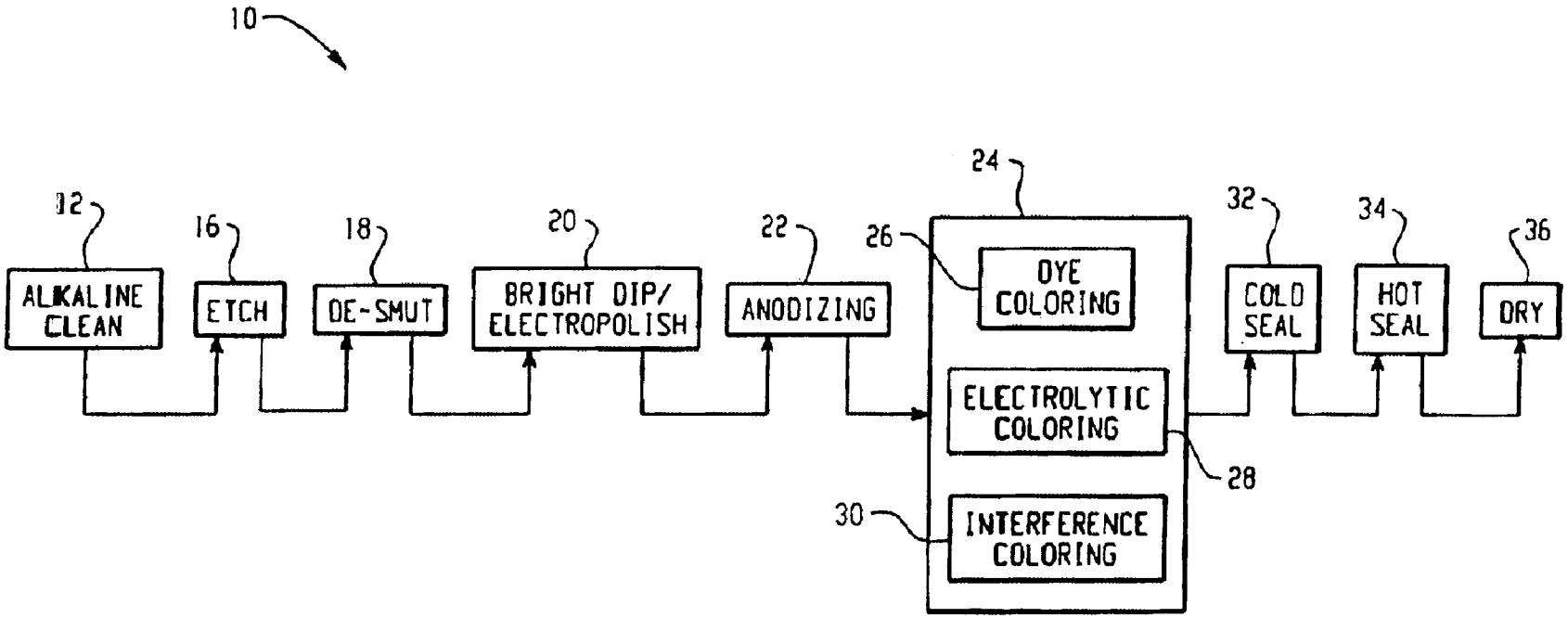
10
12
ALKALINE CLEAN
16
ETCH
18
DE-SMUT
20
BRIGHT DIP/ ELECTROPOLISH
22
ANODIZING
24
26
DYE COLORING
28
ELECTROLYTIC COLORING
30
INTERFERENCE COLORING
32
COLD SEAL
34
HOT SEAL
36
DRY

COLOR FINISHING METHOD

BACKGROUND

This disclosure relates generally to a method for color finishing aluminum or aluminum alloys, and, more particularly, to a method for providing a color-anodized finish on an aluminum- or aluminum alloy motor vehicle frame or component.

Aluminum and aluminum alloys are generally classified with a four-digit system that is based upon the principal alloying element. For example, Group 5000 generally refers to aluminum alloys that contain magnesium as the principal alloying additive whereas Group 6000 series refers to aluminum alloys that contain both magnesium and silicon as the principal alloying additives.

Aluminum motor vehicle frames and components are typically subjected to an electrostatic coloring process that provides desirable decorative effects as well as resistance to the corrosion as a result of exposure to harsh environmental conditions. Most often, a voltage differential is applied across a surface to be colored and the surface is sprayed with an electrostatic paint. Negatively charged atomized paint particles and a grounded workpiece create an electrostatic field that draws the paint particle to the workpiece, minimizing overspray. As the coating is deposited onto the workpiece, the charge dissipates through the ground and returns to the power supply completing the circuit. A protective topcoat is applied to the painted surface in a similar manner to maintain the integrity of the paint and to provide gloss effects to the finished surface.

Spraying of paints and protective topcoats, however, generally results in a substantial waste of material. Even if the distance between the spray head and the surface to be coated is minimized, errant paint particles may become deposited on surfaces other than those for which the particles are intended. In such a case, the surface coatings may be non-uniformly deposited, particularly at the contours of the surface. The non-uniform deposition of the coatings, as well as other irregularities in the coating process, may provide variations in finish quality. Moreover, surface imperfections are possible due to air molecules becoming trapped in the coating surface.

Another drawback to electrostatic finishing, particularly for coating complicated surfaces, is the Faraday cage effect, which is characterized by a tendency for charged coating particles to deposit a round entrances of cavities. The Faraday cage effect allows electric charges on a conductor to reside on the outer surface of the conductor. In the case of coating complicated surfaces, the electric charge resides on the entrances of cavities. High particle momentum can help overcome Faraday cage effects, because particles with greater momentum (larger particles or particles traveling at higher speeds) are influenced less by the electrostatic forces. However, high particle momentum also lowers efficiency.

Furthermore, even if the amount of over spray is minimized during the spraying processes, the paints and topcoat compounds are atomized, which causes the compounds to be airborne for periods of time beyond which may be necessary. The presence of airborne particles generally provide a basis for environmental concerns as well as concerns related to particle inhalation by operators.

BRIEF SUMMARY

Disclosed herein is a method for the color finishing of aluminum frames and other components for motor vehicles.

The method comprises anodizing an aluminum surface and coloring the aluminum surface. The coloring of the aluminum surface may be effected by an adsorptive coloring process, an electrolytic coloring process, an interference coloring process, or any combination of the foregoing processes.

In one embodiment, a method for color anodizing an aluminum surface of a motor vehicle comprises cleaning the aluminum surface in an alkaline cleaning process; etching the aluminum surface in an etching process; deoxidizing the aluminum surface in a deoxidizing bath; anodizing the aluminum surface in an anodizing bath; dipping the aluminum surface in a nitric acid bath; coloring the aluminum surface; and cold sealing or heat sealing the colored aluminum surface.

In another embodiment, a method of color-anodizing aluminum motor vehicle frames or components comprises immersing said aluminum motor vehicle frame or component in an alkaline cleaning solution having an elevated temperature to remove a contaminant; removing a natural oxide coating from the aluminum motor vehicle frame or component; immersing the aluminum motor vehicle frame or component in an acidic solution to desmut or deoxidize said aluminum motor vehicle frame or component; immersing the aluminum motor vehicle frame or component in a hot solution nitric, phosphoric, and sulfuric acids to bright dip/electropolish said aluminum motor vehicle frame or component; anodizing the aluminum motor vehicle frame or component in an acid solution; coloring the aluminum motor vehicle frame or component in a process selected from the group of processes consisting of adsorptive coloring, electrolytic coloring, and interference coloring; dipping the aluminum motor vehicle frame or component in solution of fluoride or silica compounds in the presence of nickel salts to cold seal the aluminum motor vehicle frame or component; immersing the aluminum motor vehicle frame or component in deionized water at a temperature of about 90° C. to about 100° C.; and drying the aluminum motor vehicle frame or component.

In another embodiment, a colored aluminum automotive body panel produced by an anodizing process comprising: cleaning the aluminum automotive body panel in an alkaline cleaning bath for about 0.1 to about 30 minutes; electropolishing or etching the aluminum automotive body panel for about 0.1 to about 30 minutes; desmutting the aluminum automotive body panel in a desmutting bath for about 0.1 to about 2 minutes; anodizing the aluminum automotive body panel in a sulfuric acid bath at as current density of about 10 to about 20 $A/ft^2$ to form a porous aluminum oxide surface at a thickness of about 5 micrometers to about 50 um; coloring the aluminum automotive body panel, wherein coloring comprises impregnating a dye into the porous aluminum oxide surface, electrolytically depositing a metal into the porous aluminum oxide surface, depositing a dielectric layer and a translucent layer over the dielectric layer, or a combination comprising at least one of the foregoing coloring processes; and sealing the aluminum body panel to produce the colored aluminum automotive body panel.

The above described and other features are exemplified by the following figure and detailed description.

BRIEF DESCRIPTION OF THE DRAWINGS

The Drawing shows a schematic representation of a method for color anodizing an aluminum motor vehicle frame, aluminum body panel, or like component.

DETAILED DESCRIPTION

Disclosed herein is a method for color anodizing aluminum motor vehicle frames and aluminum motor vehicle components. The anodizing process generally includes applying a current in an acid anodizing bath to control the quality of the coating to produce a colored coating by any one of or a combination of coloring processes. Such coloring processes are described below. Alternatively, the anodizing process can be used to produce a clear coating.

The anodizing process may be effected on motor vehicle frames or vehicle components fabricated from pure aluminum or from aluminum alloys; Frame styles that may be color-anodized include body frame integral (BFI) styles, body on frame (BOF) styles, and space frames. Although the anodizing and coloring processes hereinafter refer to frames or components fabricated from aluminum, it should be understood that the process of color anodizing described below is also applicable to frames or components fabricated from aluminum alloys. Exemplary aluminum alloys that may be color anodized include, but are not limited to, aluminum-copper alloys (Al—Cu, e.g., Group 2000 aluminum alloys), aluminum manganese alloys (Al—Mn, e.g., Group 3000 aluminum alloys), aluminum silicon alloys (Al—Si, Group 4000 aluminum alloys), aluminum magnesium alloys (Al—Mg, e.g., Group 5000 aluminum alloys), aluminum magnesium silicon alloys (Al—Mg—Si, e.g., Group 6000 aluminum alloys), and aluminum zinc alloys (Al—Zn, e.g., Group 7000 aluminum alloys). Any of the foregoing exemplary aluminum alloys may further include an alloying additive such as silicon.

Referring now to The Drawing, a process for color-anodizing aluminum motor vehicle frames or aluminum components is schematically shown at 10. The process 10 generally comprises various procedures including, but not limited to, removing surface contaminants such as grease or dirt via an alkaline and/or acid cleaning of the surfaces, etching and/or electropolishing, anodizing to form a porous aluminum oxide coating, coloring, and sealing. Coloring processes by which the anodized coating is colored include adsorptive coloring, electrolytic coloring, interference coloring, or combinations comprising at least one of the foregoing coloring processes.

Process 10 is generally carried out in an assembly line procedure in which an automated handling system guides a number of workpieces (e.g., motor vehicle frames or motor vehicle components) through a series of treatment vessels. The workpieces are simultaneously treated in each step of process 10 by being automatically deposited in and retrieved from the treatment vessels. The treatment vessels are arranged to sequentially receive batches of workpieces. In one exemplary embodiment, each treatment vessel is preferably about 6,800 cubic feet ($ft^3$) and preferably dimensioned so as to accommodate about eight motor vehicle frames. The total residence time of a motor vehicle frame in process 10 is preferably about 1 to about 5 hours, with about 1.5 to about 4 even more preferred, and with about 2 to about 3 hours most preferred.

If the aluminum workpiece includes contaminants such as cutting oils or protective coatings disposed on the surfaces of the workpiece, the contaminants are preferably removed from the surfaces prior to initiation of process 10. Removal of the contaminants may be effected by, for example, vapor degreasing the workpiece or contacting the workpiece with an acid cleaning solution. In a vapor degreasing process, the contaminants may be removed by contacting the workpiece with the vapors of materials such as 1,1,1 trichoroethane, trichloroethylene, or perchloroethylene. In the event that the aluminum alloy workpiece as received does not have this type of contamination, then this step may be omitted.

In one exemplary step of process 10, contaminants (e.g., "shop dirt") are removed from the aluminum workpieces in an alkaline cleaning process 12. The alkaline cleaning process 12 utilizes an alkaline cleaning solution that preferably comprises various sodium salts with synthetic detergents, emulsifiers, flocculents, one or more surfactants, wetting agents, and the like. For example, a suitable alkaline cleaning solution comprises trisodium phosphate at a concentration of about 5 grams per liter (g/L). Cleaning of an aluminum workpiece is most effectively conducted with the alkaline cleaning solution when the solution is well mixed and maintained at an elevated temperature. Preferably, the solution is maintained at a temperature of about 20 degrees centigrade (° C.) to about 79° C. The immersion time for the aluminum workpieces in the alkaline cleaning solution is preferably about 0.1 to about 30 minutes, with an immersion time of about 1 to about 20 minutes more preferred, with an immersion time of about 5 to about 15 minutes even more preferred, and with an immersion time of about 10 minutes most preferred.

Subsequent to alkaline cleaning process 12, the aluminum workpiece is preferably rinsed in a rinsing cycle. The rinsing cycle comprises flushing the surfaces of the workpiece with hot water to remove any traces of the alkaline cleaning solution as well as any residual contaminants loosened by the alkaline cleaning solution and remaining at the surface of the workpiece.

Once sufficiently rinsed, the workpiece undergoes an etching or electropolishing process 16 to improve the surface finish, i.e., decrease roughness. Aluminium has-a thin natural oxide coating on the surface that has to be removed prior to anodizing. This oxide coating is removed during the etching or electropolishing step. The purpose of etching or electropolishing is also to provide a matte appearance, and to remove (hide) scratches in the surface.

In etching, the workpiece is preferably immersed in a bath containing an etchant, which is usually carried out in an alkaline metal hydroxide solution often together with various additives to give an even matteness. Suitable etchants include sodium hydroxide, and combinations comprising at least one of the foregoing etchants. Increasing the temperature of the etchant bath will increase the rate of etching.

In a preferred embodiment, the etching process is about 0.1 to about 30 minutes, with about 1 to about 20 minutes more preferred, with about 5 to about 15 minutes even more preferred, and with about 10 minutes most preferred.

The workpiece is then subject to a desmutting or deoxidizing process 18 in which the workpiece is dipped in a desmutting or deoxidizing bath. The desmutting- or deoxidizing bath removes any smut (e.g., soot), oxide particles, intermetallics, silicon, and the like, which are insoluble in the alkaline cleaning solution of alkaline cleaning process 12 and/or etching or electropolishing process 16 and are not removed in the subsequent rinse cycles. One exemplary type of desmutting bath includes acid solutions such as aqueous mixtures of chromic and sulfuric acids, chromic and nitric acids, ferric sulfate/nitric/sulfuric acids, and the like. The immersion time of the aluminum workpiece in the desmutting- or deoxidizing bath is based on the rate at which the surface of the workpiece is etched to remove the smut layer by the particular acid solution employed. The immersion time for the workpiece is preferably about 15 seconds to about 5 minutes, with about 30 seconds to about 2 minutes more preferred, and with about about one minute most preferred. Suitable acid solutions not only remove smut and deoxidize the aluminum, but they further preferably do not have a detrimental effect on the aluminum surface when the workpiece is subjected to extended immersion times. The aluminum workpieces may then be rinsed in the rinse cycle to remove any residue of the acid solution.

Following desmutting or deoxidizing, the workpiece may be subjected to a bright dip/electropolishing process 20. Bright dip/electropolishing process 20 comprises immersing the workpiece into a hot aqueous-solution containing a mixture of nitric, phosphoric, and sulfuric acids. A suitable mixture is one containing (by weight) about 3% nitric acid, about 78% to about 80% phosphoric acid, about 1% sulfuric acid, and about 17% to about 19% distilled water. This mixture is preferably held at an elevated temperature. Preferably, the temperature of the bright dip solution is about 10° C. to about 95° C., with about 38° C. to about 95° C. more preferred, and with about 65° C. to about 95° C. even more preferred. The aluminum alloy workpiece is preferably immersed in the bright dip solution for at least about 2 minutes, and preferably up to about 10 minutes. The workpiece may then be rinsed in the rinse cycle.

In electropolishing, the workpiece is immersed in an electrolytic bath preferably containing acidic reagents and connected to an anode of the electrolytic bath. Current is made to flow from the anodic part to a metal cathode to do essentially the opposite of a plating process. Electric fields naturally focus on microscopic peaks, increasing the local material removal rate over that of valleys, resulting in a significantly smoother and more reflective surface with minimal material removal. Upon completion of the etching or electropolishing process 16, the workpiece is preferably subjected to the rinse cycle.

In a preferred embodiment, the electropolishing process is about 0.1 to about 30 minutes, with about 1 to about 20 minutes more preferred, with about 5 to about 15 minutes even more preferred, and with about 10 minutes most preferred.

After bright dip/electropolishing process 20, the workpiece is anodized in an anodizing process 22. Anodizing is an electrochemical conversion process effected in an acidic solution in which the surface of the aluminum metal layer is converted to a porous aluminum oxide film at an anode during the application of electrical current. In anodizing process 22, the workpiece is configured as an anode. A direct current (DC) is applied to a suitable cathode, and electrolytic communication is maintained between the cathode and the anode through a sulfuric acid electrolyte. Upon application of the current, oxygen gas is evolved at the anode (the workpiece) such that a reaction occurs between the oxygen gas and the aluminum at the surface of the workpiece to produce an aluminum oxide coating. Hydrogen gas is evolved at the cathode.

The following parameters are monitored to help control the process: current density, voltage, concentration of electrolyte, aluminum concentration, agitation of the electrolyte, and temperature. With regard to current density, the anodizing process 22 is preferably stepped, i.e., the current density is increased over time throughout the anodizing process in discrete amounts. At lower currents, the thickness of an aluminum oxide coating formed on the workpiece forms a diffusion barrier that provides a high sheen finish to the coating. Subsequent anodizing at higher currents then allows for the formation of aluminum oxide coatings that have various impacts go the surface glosses. In one exemplary embodiment of anodizing process 22, direct current is applied at less than or equal to about 5 amps per square foot of workpiece surface ($A/ft^2$). A subsequent step current density is preferably greater than or equal to about 10 $A/ft^2$, with greater than or equal to about 12 $A/ft^2$ more preferred, and with greater than or equal to about 15 $A/ft^2$ being even more preferred.

The current density is preferably kept constant during the anodizing process 22. However, the voltage will vary due to changes in temperature and the increasing oxide thickness, i.e., electrical resistance. Preferably, the voltage is between about 14 to about 18 volts. It is also noted that different alloys will have different voltage requirements to achieve the same current density.

The sulfuric acid anodizing bath preferably has a concentration of sulfuric acid of about 10 to about 25 weight percent (wt. %), with a concentration of about 12 to about 18 wt. % being more preferred. The temperature of the bath during anodizing, which affects the hardness of the anodized layer, is preferably maintained at about 15° C. to about 30° C., with a temperature of about 18° C. to about 22° C. being more preferred, and with a temperature of about 20° C. being even more preferred. Moreover, it is preferred that the bath is continuously agitated to prevent local heating.

The thickness of the porous oxide layer as well as other properties of the layer (e.g., hardness, pore size, and the like) formed during the anodizing process are functions of various factors such as the time over which the anodizing is effected, the alloy composition of the cathode, the current density, and the electrolyte temperature. Generally, at higher current densities and electrolyzing times, increased thicknesses of the porous oxide layers are deposited. Preferably, the thickness of the porous oxide layer formed during the anodizing process is about 5 micrometers (um) to about 50 um, with about 10 um to about 25 um being more preferred, and with about 12 um to about 17 um being even more preferred. Subsequent to the formation of the porous oxide layer in the anodizing process, the anodized workpiece is rinsed in the rinse cycle.

The anodized workpiece is then subjected to a coloring process 24. Coloring may be provided to the anodized workpiece by any one or a combination of various methods including, but not limited to, adsorptive coloring, electrolytic coloring, and interference coloring. The adsorptive coloring process (hereinafter referred to as "dying process 26") is one in which a dye is introduced into the pore openings of the oxide layer. The dyes used in dying process 26 are preferably organic in nature and water insoluble. Such dyes are introduced into the porous oxide layer via dipping, spraying, and the like Once introduced into the porous oxide layer, the dye is adsorbed in the surface region of the oxide coating via the pores. Because the pore structure of the oxide layer of the anodized workpiece is substantially uniform, and because the particles of a dye are substantially smaller than the particles of a paint pigment (and therefore more easily adsorbed into a pore), colors over a wide range of the spectrum may be obtained with a high degree of uniformity. Furthermore, such colors are highly reproducible amongst workpieces of the same batch. If dying process 26 is to be utilized in conjunction with any other coloring process, the anodized and dyed workpiece may be rinsed in the rinse cycle prior to being subjected to such other coloring process. If dying process 26 is the only process by which the workpiece is colored, then the workpiece is transferred to a cold seal process 32, as is described below.

In the electrolytic coloring process, shown at 28, color is imparted to the oxide layer via electrolytic deposition of metal particles at the pores of the oxide layer. The deposition of particles is effected by the application of alternating current to a metal salt solution. Because the sizes of the deposited particles are smaller than the pore openings in the oxide layer, the particles are deposited at the bottoms, as well as the sides, of the pores. Metal salt solutions that may be utilized for the electrolytic deposition of metal particles include, but are not limited to, aqueous solutions of tin, cobalt, nickel, copper, and the like. If electrolytic coloring process 28 is utilized in conjunction with another coloring process, the electrolytically-colored workpiece may be rinsed in the rinse cycle prior to being subjected to the other coloring process. If electrolytic coloring process 28 is the only process by which the workpiece is colored, then the workpiece is transferred to cold seal process 32, as is described below.

In the interference coloring process, shown at 30, selected wavelengths of incident light are optically filtered or eliminated by layers applied at the surface of the anodized workpiece. Such layers are generally produced by the deposition of a dielectric layer on the anodized surface and the deposition of a translucent metal layer over the dielectric layer. The thickness of the layers (particularly the dielectric layer) produces various color effects within an interference-colored coating. The dielectric layer may be applied via a physical vapor deposition (PVD) method such as sputtering, vapor deposition, or the like, or by a direct current method, e.g., by anodic oxidation of the anodized aluminum surface using direct current and a sulfuric acid electrolyte. The translucent metal layer is typically deposited by a physical vapor deposition (PVD) method such as sputtering, vapor deposition, or the like, or by chemical vapor deposition, or by direct chemical precipitation, or by electrochemical methods. If interference coloring process 30 is utilized in conjunction with another coloring process, the interference-colored workpiece may be rinsed in the rinse cycle prior to being subjected to the other coloring process. If interference coloring process 30 is the only process by which the workpiece is colored, then the workpiece is transferred to cold seal process 32, as is described below.

Where a combination of the above noted coloring processes are employed, it is preferred that the electrolytic coloring process occur prior to the dying and interference processes. Likewise, it is preferred that the dying process occur prior to the interference coloring process.

Once the work piece has been dyed, it is sealed, simply exposing the workpiece to cold seal process 32 and/or a hot seal process 34. Cold seal process 32 is preferably based on dipping solutions that contain fluoride or silica compounds in the presence of nickel salts, and often in a water-alcohol mixture. The water-alcohol solvent apparently lowers the solubility of the salts and facilitates precipitation of the salts within the pores of the anodic film. A preferred cold sealing solution contains a nickel compound such nickel acetate, a fluoride compound, and n-butanol. Preferably, the cold sealing temperature is at about 24° C. to about 32° C. at a pH of about 5.0 to about 7.0.

Hot seal process 34 comprises immersing the workpiece in deionized water at a temperature of about 90° C. to about 100° C. Hot seal process 34, because of the porosity of the oxide, hydrates the crystalline aluminum layer, which swells-the oxide to close the pores, thereby sealing the dye within. The workpiece is then rinsed and subjected to a drying process 36.

The above-described process provides several advantages over those processes by which aluminum and aluminum alloy frames and components are colored. In particular, the process provides for the coloring of about fifty motor vehicle frames in one or a combination of colors over about a two and one half hour time period, while conventional spray coating processes utilize assembly line formats to systematically coat one workpiece at a time. Because of the well-established tooling of the assembly line format and the automotive industry's reliance on such a format, the potential applicability and benefits of batch- or semi-batch processing is often overlooked.

Furthermore, automation of the process, i.e., the system-controlled transfer of the workpieces between process stations, enables the coloring process to be effected with less manpower. Moreover, the coloring processes described provide attractive alternatives to conventional spray painting of frames and components.

The actual coloring of the aluminum surfaces provides further advantages to conventionally-colored aluminum frames and components. More specifically, both the electrolytic deposition of metal particles at the pores of the oxide layer and the deposition of layers to provide interference coloring provide superior coatings that are resistant to fading as a result of exposure to ultraviolet radiation. Moreover, interference coloring generally provides desirable color, gloss, and other surface effects that are not attainable with dye coloring or electrolytic coloring. Again, because the automotive industry has relied on assembly line production and simple spray processes of applying coatings, the potential for other methods of coating have been ignored.

While the invention has been described with reference to one exemplary embodiment, it will be understood by those skilled in the art that various changes may be made and equivalents may be substituted for elements thereof without departing from the scope of the invention. In addition, many modifications may be made to adapt a particular situation or material to the teachings of the disclosure without departing from essential scope of the invention. Therefore, it is intended that the invention not be limited to the particular embodiment disclosed as the best mode contemplated for carrying out this invention, but that the invention will include all embodiments falling within the scope of the appended claims.

What is claimed is:

1. A method for color anodizing an aluminum surface of a motor vehicle, said method comprising; in sequence:

cleaning said aluminum surface in an alkaline cleaning process;

etching said aluminum surface in an etching process;

deoxidizing said aluminum surface in a deoxidizing bath;

anodizing said aluminum surface in an anodizing bath;

dipping said aluminum surface in a nitric acid bath;

coloring said aluminum surface; and cold sealing or heat sealing said colored aluminum surface.

2. The method of claim 1, further comprising removing a contaminant from said aluminum surface in a vapor degreasing process.

3. The method of claim 1, further comprising rinsing said aluminum surface in a rinse cycle.

4. The method of claim 1, wherein said anodizing comprises increasing a current density applied to said aluminum surface in discrete amounts.

5. The method of claim 1, wherein said coloring comprises adsorbing a dye at an oxide layer of said aluminum surface.

6. The method of claim 5, wherein said adsorbing said dye at said oxide layer comprises applying a dye via a process selected from the group consisting of dipping and spraying.

7. The method of claim 1, wherein said coloring comprises electrolytically depositing particles of a metal salt solution at an oxide layer of said aluminum surface.

8. The method of claim 1, wherein said coloring comprises applying a color at an oxide layer of said aluminum surface via an interference coloring process.

9. The method of claim 8, wherein said interference coloring process comprises, depositing a dielectric layer at said oxide layer, and depositing a translucent metal layer at said dielectric layer.

10. A method of color-anodizing aluminum motor vehicle frames or components, said method comprising in sequence:

immersing said aluminum motor vehicle frame or component in an alkaline cleaning solution having an elevated temperature to remove a contaminant;

removing a natural oxide coating from said aluminum motor vehicle frame or component;

immersing said aluminum motor vehicle frame or component in an acidic solution to desmut or deoxidize said aluminum motor vehicle frame or component;

immersing said aluminum motor vehicle frame or component in a hot aqueous solution containing a mixture of nitric, phosphoric, and sulfuric acids to bright dip/electropolish said aluminum motor vehicle frame or component;

anodizing said aluminum motor vehicle frame or component in an acid solution;

coloring said aluminum motor vehicle frame or component in a process selected from the group of processes consisting of adsorptive coloring, electrolytic coloring, and interference coloring;

dipping said aluminum motor vehicle frame or component in solution of fluoride or silica compounds in the presence of nickel salts to cold seal said aluminium motor vehicle frame or component;

immersing said aluminum motor vehicle frame or component in deionized water at a temperature of about 90° C. to about 100° C.; and drying said aluminum motor vehicle frame or component.

11. The method of claim 10, wherein said removing of said natural oxide coating from said aluminum motor vehicle frame or component comprises immersing said aluminum motor vehicle frame or component in a sodium hydroxide solution to etch said aluminum motor vehicle frame or component.

12. The method of claim 10, wherein said removing of said natural oxide coating from said aluminum motor vehicle frame or component comprises, immersing said aluminum motor vehicle frame or component in an electrolytic bath of acidic reagents, connecting said aluminum motor vehicle frame or component to an anode of said electrolytic bath, and causing a current to flow from said anode to a cathode of said electrolytic bath to electropolish said aluminum motor vehicle frame or component.

* * * * *